US005095842A

United States Patent [19]

Soules

[11] Patent Number: 5,095,842

[45] Date of Patent: Mar. 17, 1992

[54] COLLAPSIBLE ANCHOR HAVING RELEASABLE FLUKES

[76] Inventor: Jack A. Soules, 3009 Van Aken Blvd., Shaker Heights, Ohio 44120

[21] Appl. No.: 769,180

[22] Filed: Sep. 30, 1991

[51] Int. Cl.[5] ..... B63B 21/24

[52] U.S. Cl. ..... 114/299; 114/310; 114/210; 114/297

[58] Field of Search ..... 114/297-299, 114/294, 210, 301, 302, 304, 310; 52/155, 162

[56] References Cited

U.S. PATENT DOCUMENTS

| | | | |
|---|---|---|---|
| 2,568,006 | 9/1951 | Illsche | 114/299 |
| 2,816,522 | 12/1957 | Root | 114/299 |
| 3,024,756 | 3/1962 | Ogg | 114/310 |
| 3,150,627 | 9/1964 | Fields | 114/299 |
| 4,369,727 | 1/1983 | Fased | 114/287 |
| 4,951,593 | 8/1990 | Brown | 114/299 |

FOREIGN PATENT DOCUMENTS

| | | | |
|---|---|---|---|
| WO8300126 | 1/1983 | PCT Int'l Appl. | 114/299 |

*Primary Examiner*—Joseph F. Peters, Jr.
*Assistant Examiner*—Clifford T. Bartz
*Attorney, Agent, or Firm*—Alfred D. Lobo

[57] ABSTRACT

A simple, easily affordable and portable, yet rugged and reliable, collapsible anchor is disclosed for use with small water craft, particularly those susceptible to damage by sharp edges or protuberances of a conventional non-collapsible anchor stower aboard. When snagged, the anchor is self-tripped by a force exerted in a direction upstream from where the craft was anchored. The force trips a release mechanism which allows a pair of flukes to rotate in an "A"-shaped spring yoke in which they are held, and unsnag the anchor. The flukes are nonrotatably disposed on a fluke shaft which is journalled in the lower terminal portions of the yoke's two spring arms. The upper terminal portions (apex) of the yoke are held together by a fulcrum pivot (shoulder bolt) means. The release mechanism comprises, a spreader bar having a clevis in its upper terminal portion and a release pin in its lower terminal portion, the release pin being biased against the spring arms; and, a line lever having a through-bore in its lower terminal portion and a cam end, the anchor line being attached to the other end. The line lever is pivotable about the fulcrum pivot member, and held in the clevis so that the spreader bar is rotatably disposed on the same fulcrum pivot.

9 Claims, 4 Drawing Sheets

COLLAPSIBLE ANCHOR HAVING RELEASABLE FLUKES

BACKGROUND OF THE INVENTION

This invention related to a portable, readily deployable collapsible anchor, so termed because it has a pair of flukes which are rotatable in a yoke when a release mechanism is triggered. A snagged anchor may be released by pulling upon the deployed anchor's line in a direction which triggers the mechanism. The rotatable flukes allow the anchor to be stored in a "collapsed" or "folded" position. The magnitude of the force required to be exerted is predetermined by the construction of the anchor and is relatively constant. This force is essentially unrelated to the force exerted on the flukes when the anchor is engaged, snagged or not.

More specifically, this invention relates to an anchor which will be used by persons of tightly circumscribed means, who routinely use small water craft in relatively shallow waters under conditions aptly suited to snagging an anchor.

Still more specifically, this invention is directed to (a) obviating the problem of coping with the large force required to release an anchor having a construction in which such force is proportional to the load on engaged flukes (the force exerted on the flukes, particularly when the flukes are snagged);

(b) using a minimum number of parts the interaction of which is substantially insensitive to being fouled by underwater detritus when the anchor is snagged in a rock crevice, or under a heavy log, and must be unsnagged; and, (c) using parts which are inexpensive to manufacture.

In the prior art there exist a variety of anchors having flukes which are released by a mechanism which is highly sensitive to the magnitude of the force exerted on the flukes. Among such anchors are those in which a central locking plug is required to be pulled away from the flukes. Because the force required to remove the locking plug increases as the force exerted on the flukes increases, the flukes are proportionately more tightly biased against the plug as the force on the anchor line increases.

Examples of anchors with locking plug construction may be found in U.S. Pat. Nos. 3,656,448; 3,747,553; 4,038,934; 4,057,024; and 4,261,281; inter alia.

The concept of using an anchor attachment line lever ("line lever" for brevity) to transmit the force required to operate a release mechanism was used in U.S. Pat. No. 4,369,727 to Fasco (class 114/subclass 297). However, the line lever was pivoted in the anchor, to function as a crank for changing the direction of the rectilineal force exerted on the anchor's line to a direction at right angles to that rectilineal direction, the net result of which is to retract a sliding bar in a slot. An elongated pivoted member connected to a fluke assembly is biased against the sliding bar, so that when the sliding bar is raised, the flukes are released. Such construction of the Fasco anchor, apart being different from that of this invention, fails to isolate the force exerted on the flukes (which is transmitted to the pivoted member) from the force required to release the flukes. As is evident, the greater the force exerted by the flukes, the greater the force exerted by the pivoted member on the sliding bar, and the greater the force required to retract the sliding bar in the slot.

SUMMARY OF THE INVENTION

It has been discovered that an anchor having a pair of flukes may be constructed using the minimum number of parts to provide the function of the anchor and at the same time provide a release mechanism which can be triggered by a releasing force essentially unrelated to the snagging force exerted on the flukes of a snagged anchor.

It is therefore a general object of this invention to provide an anchor in which the force required to trigger a release mechanism within the anchor is essentially uninfluenced by external forces acting upon the anchor.

It is another general object of this invention to provide an anchor deployed with a single anchor line and having a pair of flukes fixedly disposed on a fluke shaft rotatably disposed in the terminal spread-apart portions of an "A"-shaped yoke having "A"-arms referred to as "spring arms" because they spring inwards when a release mechanism in the anchor is triggered; the flukes are operatively connected to the release mechanism actuated by a force exerted on a pivotable line lever which effects rotation of a release pin, displacing it from between a pair of spring arms separated by the release pin; and, the force required to effect rotary displacement of the release pin is essentially unrelated to the force exerted on the flukes of the snagged anchor.

It is a specific object of this invention to provide a collapsible anchor to be deployed with a single anchor line to anchor a relatively small water craft, said anchor comprising, a spring yoke having an "A"-shape, said spring yoke comprising a pair of spring arms symmetrically disposed about a central vertical plane, said spring arms having upper and lower terminal portions having longitudinally aligned upper and lower through-bores, respectively, said lower terminal portions being longitudinally spaced apart at a distance greater than said upper terminal portions, each said lower portion having a longitudinally outwardly projecting first detent means;

a fluke assembly comprising a pair of flukes fixedly disposed at opposite ends of a fluke shaft which is journalled in said lower through-bores of said spring arms, each said fluke having fixedly disposed near the inner edge thereof, a second detent means including a pair of diametrically opposite, longitudinally spaced apart, radially outwardly directed, detent tabs in selective interfering relationship with said first detent means;

an actuator assembly pivotally connected between the spring arms near the apex thereof, said actuator assembly comprising a spreader bar having a clevis in its upper terminal portion, and a release pin projecting through said spreader bar's lower terminal portion, said clevis having aligned through-bores in its arms, and said release pin exerting a predetermined force to spread said spring arms apart;

an anchor line attachment lever having an upper terminal portion for attaching said anchor line, and a lower terminal portion having a through-bore and a camming end; and, a fulcrum pivot member securing said upper terminal portions of said spring arms, said arms of said clevis, and said lower terminal portion of said line lever so that said spreader bar is rotatably disposed on said fulcrum pivot member, said line lever is pivotably disposed on said fulcrum pivot member so as to engage said camming end with said upper terminal portion of said spreader bar.

It is a specific object of this invention to provide a collapsible or foldable anchor having the construction described hereinabove, which anchor may be stored in a floatable cushion which may be used as a seat in a raft or boat, and also serve as a fender or bumper for protecting the craft against damage.

BRIEF DESCRIPTION OF THE DRAWINGS

The foregoing and additional objects and advantages of the invention will best be understood by reference to the following detailed description, accompanied with schematic illustrations of preferred embodiments of the invention, in which illustrations like reference numerals refer to like elements, and in which.

DETAILED DESCRIPTION OF PREFERRED EMBODIMENTS

Figure 1:
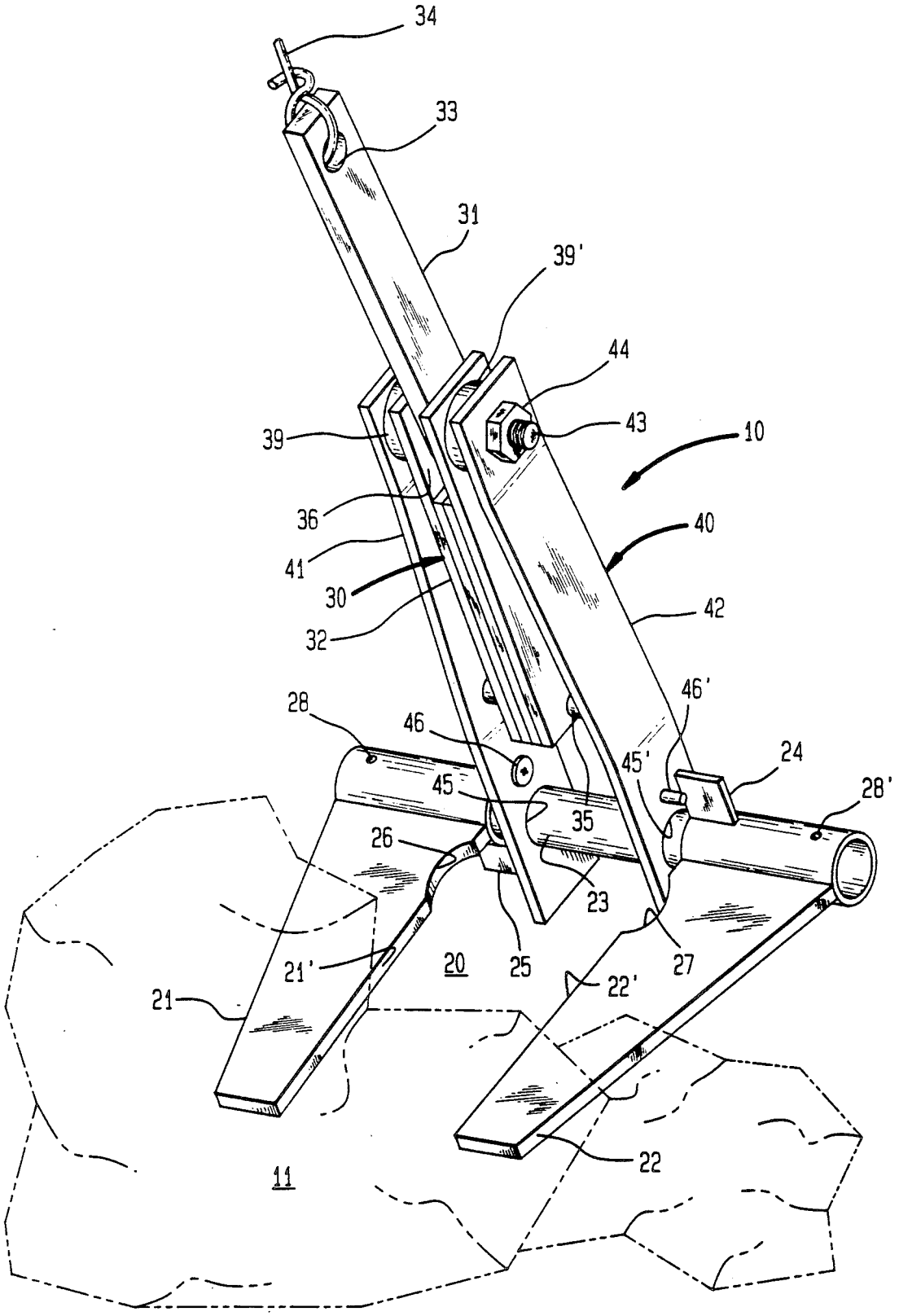
FIG. 1 is a perspective view of the anchor anchoring a small water craft with an anchor line at an angle to the lateral plane of the underwater terrain in a rocky crevice of which the anchor is snagged.

In a preferred embodiment the anchor of this invention is specifically for use in a small water craft such as a small boat, particularly if it is an inflatable boat or raft. As is well recognized, such craft are operated in relatively shallow waters, often hiding fallen trees, sunken logs and the like, and often in rocky terrain.

Referring to there is shown a perspective view of an anchor, referred to generally by reference numeral 10, lodged in a crevice of an underwater rocky formation 11 in such a way that but for the release mechanism to be described in greater detail hereafter, the anchor would be irretrievable.

The anchor 10 comprises a fluke assembly 20 and the release mechanism which includes an actuator assembly 30 and an A-shaped spring yoke 40.

The spring yoke 40 is so termed because it has a pair of elongated, bent, metal strips 41 and 42 which are symmetrically disposed in mirror-image relationship about a vertical plane (y-z plane, the y-axis being the transverse axis and the z-axis being the vertical). The strips 41 and 42 are pivotable about a shoulder bolt 43, threaded only near its end, inserted through longitudinally (x-axis) aligned upper through-bores (not visible) in the upper terminal portion of each strip, and the strips are threadedly secured by a nut 44 on the end of the bolt to form the apex of the "A" shape of the yoke 40.

The strips 41 and 42 are bent in such a way that their lower ends, which define the base of the "A" shape, flare outwards so as to space-apart a pair of longitudinally aligned lower through-bores 45 and 45' in the lower terminal portion of each strip. Intermediate the upper and lower through-bores and near the latter, a pair of oppositely disposed detent means, preferably, shearable detent pins 46 and 46' project outwards along the x-axis. The shape of the detent means is not narrowly critical provided each detent serves a detent function allowing the anchor 10 to moor the water craft.

Figure 5:
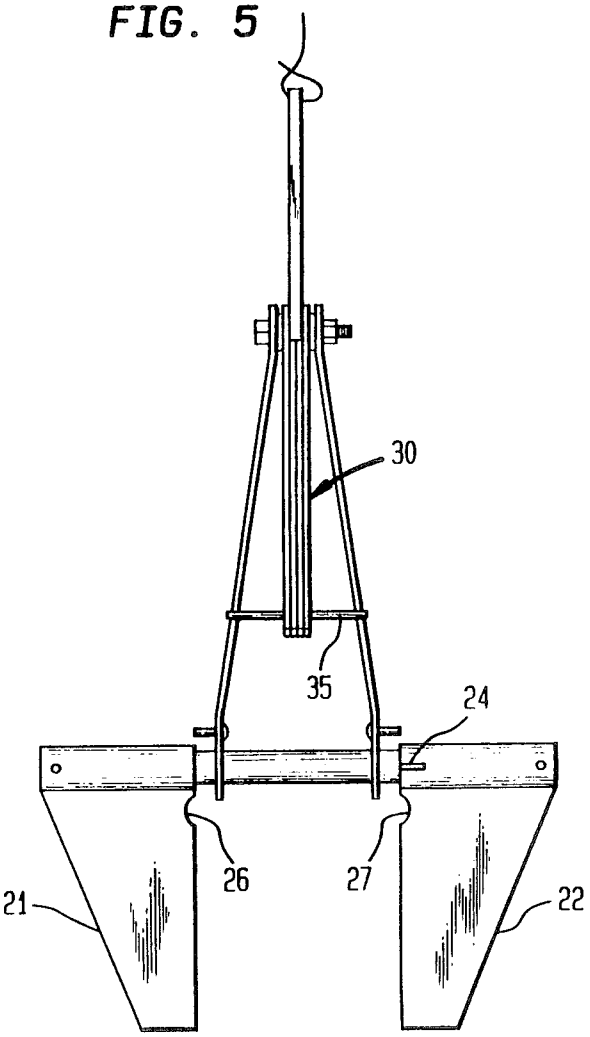
FIG. 5 is a frontal view of the anchor illustrated in FIG. 2, namely, following triggering of the release mechanism.
Figure 4:
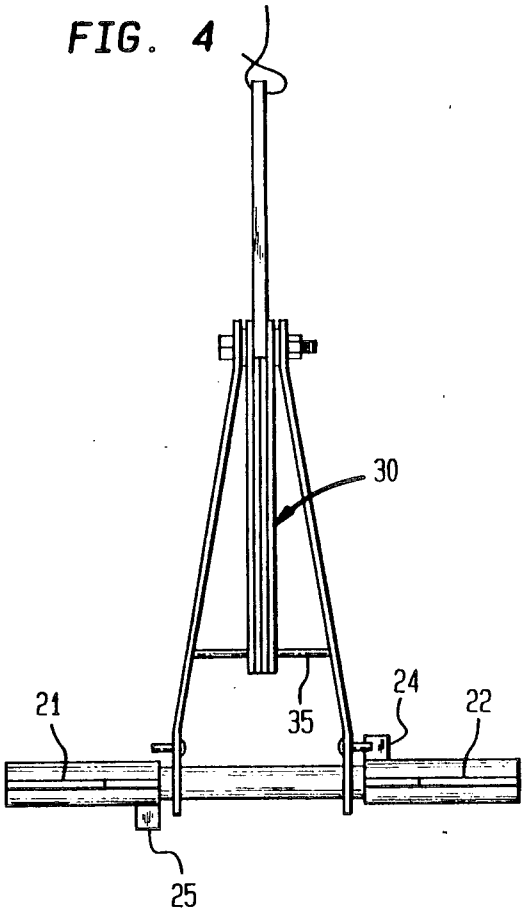
FIG. 4 is a frontal view of the invention as it would appear when deployed.
Figure 3:
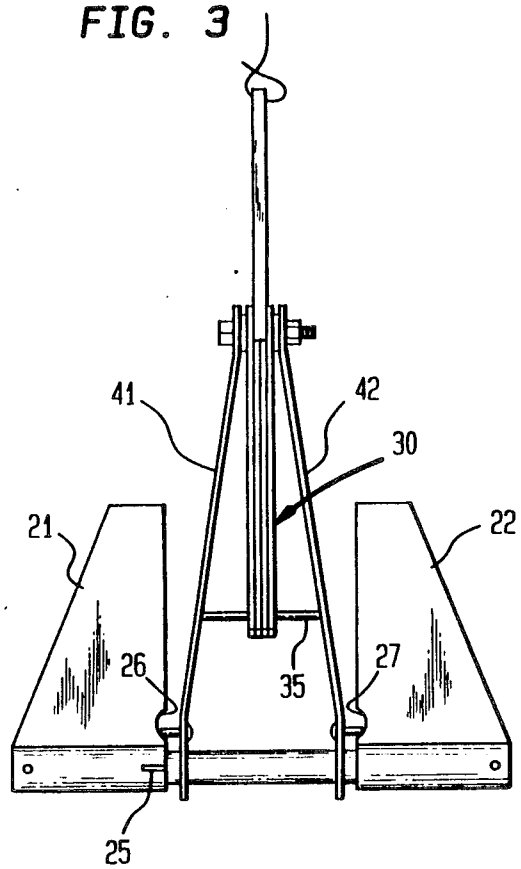
FIG. 3 is a frontal view of the invention as it would appear prior to deployment, i.e. while stored in a sheath.

As illustrated more clearly in FIGS. 3–5, spring arms 41 and 42 are bent so as to have short upper terminal portions 47 and 47', and short lower terminal portions 48 and 48' in parallel, each lower terminal portion being spaced longitudinally spaced apart from its corresponding upper terminal portion by the side of the right triangle formed by the angulated strip with the x-axis.

The actuator assembly 30 comprises an anchor line attachment lever ("line lever" for brevity) 31 and a spreader bar 32. The line lever 31 is provided near its upper end with a through-bore 33 for attachment of anchor line 34. Line lever 10 is provided near its lower end 37 with a through-bore (not visible) in which shoulder bolt 43 is inserted so that the shank of the bolt serves both as a fulcrum for the line lever 10, and also as a pivot about which the line lever is pivotable. The bolt is therefore referred to as a fulcrum pivot member.

The spreader bar 32 is so termed because its function is to keep spring arms 41 and 42 of the spring yoke 40 axially spread apart (x-axis) when the anchor is deployed. This function is specifically discharged by a release pin 35 projecting outwards on either side of the lower terminal portion of the spreader bar 32. The upper portion of the spreader bar 32 terminates in a clevis 36 having aligned through-bores through which shoulder bolt 43 is inserted so that the spreader bar 32 is pivotable about the bolt 43.

The bottom of trough 38 (FIG. 2) between the arms of the clevis 36 provides a camming surface against which the end of the lower end 37 of line lever 31 may be cammingly engaged to force the spreader bar 32 and the release pin 35 out of the x-z plane in which they were held between spring arms 41 and 42.

Figure 2:
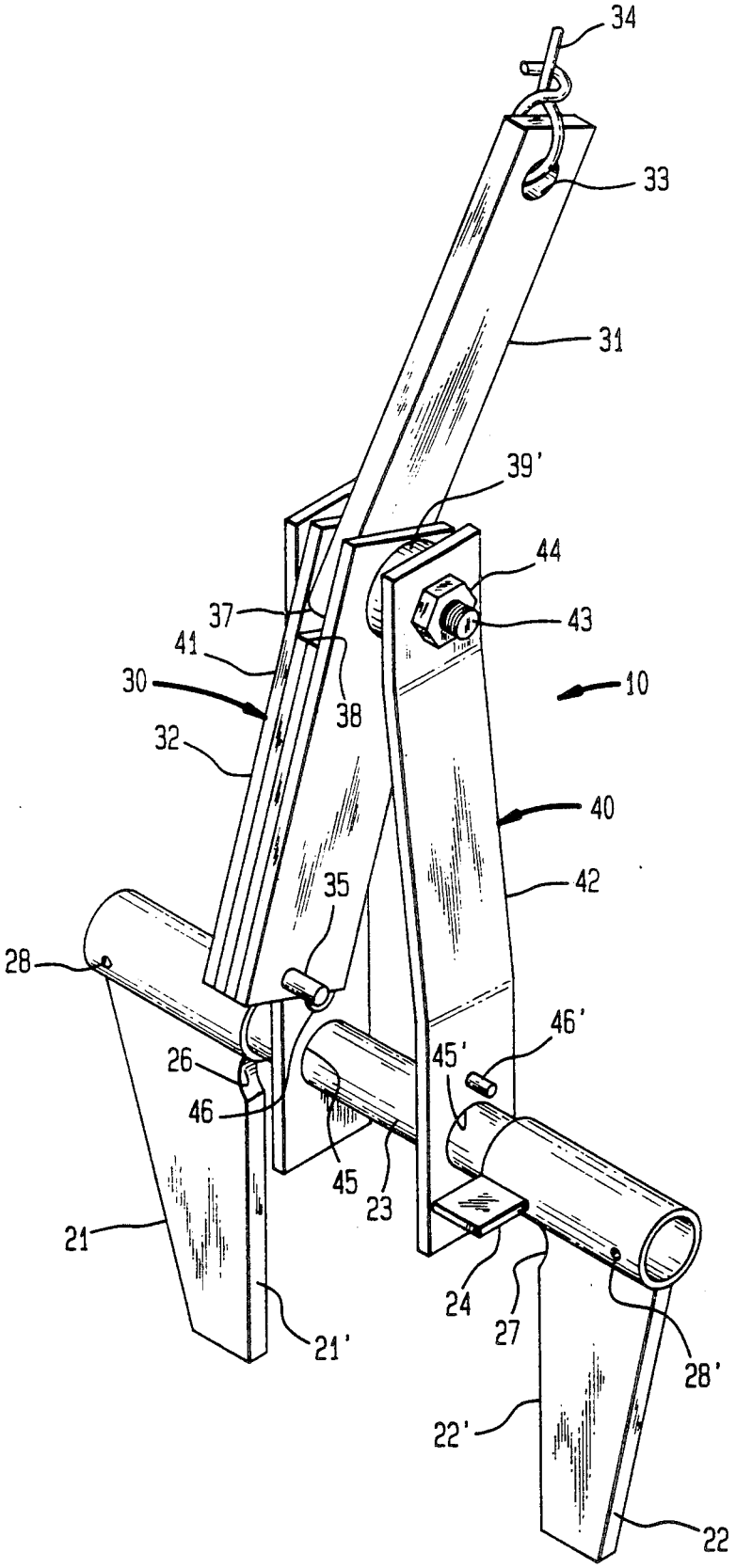
FIG. 2 is a perspective view of the anchor following displacement of the release pin which in turn results in downward rotation of the flukes.

As particularly illustrated in FIGS. 3–5, it is seen that the lower end 37 of line lever 31 is pivotably disposed on fulcrum pivot 43 so as to provide a camming function between the arms of clevis 36. Such a camming function is effected because the lower end (referred to as the "cam end" or "camming end") 37 of line lever 31 and the clevis 36 are each independently pivotable about the same fulcrum pivot 43 until engagement of the cam end in the clevis. A pair of spacer washers 39 and 39' are interposed between the outer surfaces of the clevis 36 and the inner surfaces of the upper portions of spring arms 41 and 42 to facilitate relative movement between the spreader bar and spring arms, as illustrated in FIG. 2, and to adjust the magnitude of the outward force exerted by a release pin 35 of chosen length.

As will now be evident from the illustrations, pulling on the anchor line 34 in a direction in which the line lever 31 and the spreader bar 32 are axially aligned will not self-trip a snagged anchor's release mechanism. If the force is great enough, the detent (shear) pins will be sheared. The anchor can only be self-tripped if the direction of the force exerted on the line 34 is such that it tends to rotate the line lever 34 on the fulcrum pivot 43. Such a force is most preferably applied by a person guiding his water craft back upstream of the snagged anchor within an area defined by lines at about a 45° angle to the central vertical y-z plane of the anchor. It is most preferred that the person travel upstream until he passes over the snagged anchor, travelling in a line in a generally vertical y-z plane, until he is at a sufficient distance to exert enough force at an angle which permits the line lever 31 to pivot and cam the camming end 37 against the trough of the clevis 38, thus causing rotary displacement of the release pin 35.

The fluke assembly 20 includes a pair of flukes 21 and 22 fixedly, oppositely disposed in longitudinally spaced-apart relationship, one near each opposed end of a fluke shaft 23, preferably by welding each fluke to the fluke shaft, or with rolled pins 28 and 28' (shown). The fluke shaft 23 is journalled in the through-bores 45 and 45' in the lower ends of the spring arms 41 and 42 respectively, so that the flukes are exteriorly disposed relative to the spring yoke; and, freely rotatable about the x-axis unless such rotation is stopped by a detent pin. Each fluke shaft has the general shape of a right triangle with a truncated apex, the right angle of each fluke being adjacent the spring yoke so that inner edges 21' and 22' of the flukes 21 and 22 respectively are substantially parallel and fixedly disposed on the same side of the fluke shaft 23.

In the preferred embodiment illustrated herein, the inner edges 21' and 22' and the outer surfaces of the spring arms 41 and 42 respectively, are closely spaced. Therefore, the inner edges 21' and 22' are provided with clearance slots 26 and 27 to permit the flukes to clear the detent pins 46 and 46' when the flukes are rotated either into a vertical position whether upwards (as shown in FIG. 3) or downwards (as shown in FIG. 5). It will be apparent, particularly from FIG. 4, that if the flukes are less proximately disposed than shown, longer (measured along the x-axis) detent tabs 24 and 25 would be required, and they would project inwardly beyond the inner edges of the flukes, to provide the necessary engagement of a detent tab with a detent pin.

In addition to the flukes 21 and 22, the fluke shaft 23 is provided with fixedly secured, radially projecting, detent tabs 24 and 25 positioned to selectively interfere with pin detents 46 and 46' to restrict rotation of fluke shaft 23. The relative positions of the tabs 24 and 25 is such that they are diametrically oppositely disposed, though longitudinally spaced apart, so that when the anchor 10 is engaged (referred to as the "deployed position"), only a single detent tab being engaged with a detent pin. Thus when the flukes 21 and 22 are in the lateral (x-y) plane, as shown in FIG. 4, tab 24 projects vertically upwards, and tab 25 projects vertically downwards. In the deployed position, tab 24 is biased against the detent pin 46' (which position is referred to hereinabove) so that the deployed anchor 10 is typically engaged in an anchoring surface at an angle to the vertical when it anchors the water craft as shown in FIG. 1.

Figure 6:
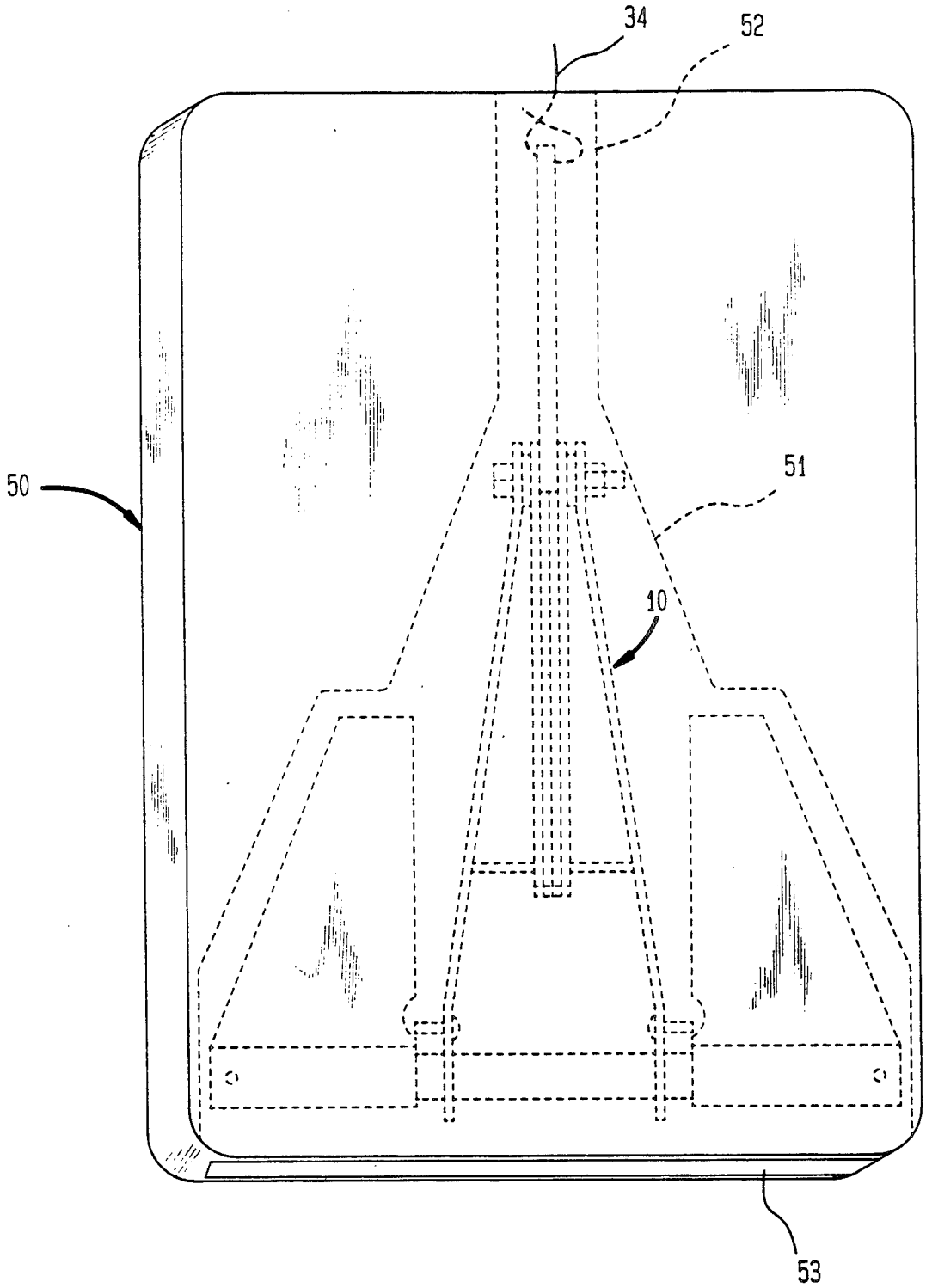
FIG. 6 is a plan view of an anchor stored in a integral sheath of foamed synthetic resinous material in the form of a generally rectangular parallelpiped.

It will now be evident that because of the 180° apart positions of the tabs 24 and 25, the fluke shaft is rotatable so as to position the flukes pointing vertically upward as is illustrated in FIG. 3, irrespective of whether the release pin 35 is held between the spring arms 41 and 42. In the "folded" or "storage" position release pin 35 is preferably held in place by the force exerted by the spring arms 41 and 42, so that the anchor 10 may be deployed immediately from within a storage sheath 50 in which it is stored, as illustrated in FIG. 6.

Referring to FIG. 2 there is shown the anchor 10 in the "released" position which enables it to be retrieved from the crevice in the rocky formation 10, or other essentially immovable object against which the anchor is wedged, as shown in FIG. 1. In the released position, displacement of the release pin out of the x-z plane permits the spring arms 41 and 42 to contract, retracting detent pins 46 and 46' inwardly towards the central vertical plane, and allowing detent tab 24 to clear detent pin 46' (see FIG. 1).

Force exerted by the flukes against the detent pin 46' is in the transverse direction (y-axis). The greater the force exerted by the flukes, the greater the force on the pin 46', and the more tightly will fluke shaft 23 bear against the surfaces of the bores in the lower end of the spring arms. If sufficiently great, the detent pin 46' will shear and the anchor will be released. However, substantially irrespective of the magnitude of the force on the detent pin 46', and prior to shearing it, the force required to displace the release pin 35 by pulling on line 34 in a direction such as to cam the camming end 37 against the camming surface 38 of the clevis 36, is substantially unaffected because the force exerted by the spring arms against the release pin is essentially unaffected by the force exerted by the detent tab 24 against detent pin 46'.

In the best mode of the invention illustrated in FIG. 1, the anchor 10 is constructed of steel, preferably provided with a suitable corrosion-resistant coating. The flukes 21 and 22, spreader bar 30 and spring arms 41 and 42 are constructed of laminar metal stock, such as mild steel sheet in the range from about 0.0625" to about 0.375" thick, cut into strips. The flukes are formed by bending the stock around the fluke axle 23 to conform to its circumference, and welding. The tabs 24 and 25 are then welded to the flukes. The spreader bar is formed by welding together several strips of metal, as illustrated. The attachment line lever 31 is a short bar of heavier steel stock the camming end of which is provided with radiused corners to facilitate the interaction of the cam with the inner surface of the clevis' trough. The dimensions of the parts will be determined by the proposed load expected to be carried by the anchor.

The lengths of the line lever 31 and spreader bar 32 are determined by the release force desired to displace the release pin 35 by pulling on the anchor line 34. The required release force is a function of the magnitude of the bias of the spring arms 41 and 42 against the release pin 35, and the coefficient of friction between the inner surfaces of the spring arms and the release pin. In a preferred embodiment, the lengths of the line lever and the spreader bar are approximately equal.

The spread of the yoke's spring arms and angle of separation between the spreader bar and each spring arm is determined by the desired width of the anchor, which typically will be no wider than is necessary for the purpose at hand, since cost of the anchor and the necessary inconvenience of carrying and storing it dictate that the anchor be small.

As illustrated, the angulation of each spring arm to the vertical ranges from about 2°–20° depending upon the width of the anchor and the physical (manual) force required to be exerted to reset the release pin after an anchor in the released position has been retrieved.

The length of the release pin 35 is chosen to keep the spring arms 41 and 42 sufficiently spread apart so that the shear pins 46 and 46' will be suitably positioned in selective interfering relationship with the tabs 24 and 25. It is most preferred to round off the ends of the release pin to match the radius of dimples provided in the inner surface of the spring arms, in which dimples the release pin is indexed in the central vertical x-z plane of the anchor.

Reverting now to FIG. 6, there is shown in phantom (dotted) outline, an anchor in the storage position, stored within a unitary sheath 50 of foamed closed cell synthetic resinous material, such as polystyrene but preferably polyurethane having a bulk density lower than that of water, which may serve the dual purpose of a cushion upon which one may sit, and a fender (or bumper) to protect the craft against damage from impact with a dock, rocky cliff or the like, yet float on the water when the anchor is deployed.

The sheath has a generally rectangular parallelepiped shape having a sufficient height (thickness) to encapsulate the folded anchor yet have an additional thickness sufficient to provide adequate cushioning for the purpose at hand. The sheath has a central shallow cavity 51 which is approximately shaped to conform to the flat shape of the folded anchor 10. It will be appreciated that the anchor in the "stored" position has the release pin 35 between the spring arms 41 and 42 as shown, and is therefore essentially flat, making it easy to store. The sheath 50 has a through-passage 52 in its top which passage communicates with the cavity 51. The anchor line 34 is passed through the passage 52. The sheath is also provided with a longitudinal opening 53 in the bottom of the sheath, which opening is the lower portion of the cavity 51. The folded anchor may be easily slipped into and out of the sheath.

Having thus provided a general discussion, described the collapsible anchor in detail and illustrated the invention with specific examples of the best mode of constructing and using the anchor, it will be evident that the invention has provided a simple but effective solution to a difficult problem. It is therefore to be understood that no undue restrictions are to be imposed by reason of the specific embodiment illustrated and discussed, except as provided by the following claims.

I claim:

1. A collapsible anchor to be deployed with a single anchor line to anchor a relatively small water craft, said anchor comprising, a spring yoke having an "A"-shape, said spring yoke comprising a pair of spring arms symmetrically disposed about a central vertical plane, said spring arms having upper and lower terminal portions having longitudinally aligned upper and lower through-bores, respectively, said lower terminal portions being longitudinally spaced apart at a distance greater than said upper terminal portions, each said lower portion having a longitudinally outwardly projecting first detent means;

a fluke assembly comprising a pair of flukes fixedly disposed at opposite ends of a fluke shaft which is journalled in said lower through-bores of said spring arms, each said fluke having fixedly disposed near the inner edge thereof, a second detent means including a pair of diametrically opposite, longitudinally spaced apart, radially outwardly directed, detent tabs in selective interfering relationship with said first detent means;

an actuator assembly pivotally connected between the spring arms near the apex thereof, said actuator assembly comprising a spreader bar having a clevis in its upper terminal portion, and a release pin projecting through said spreader bar's lower terminal portion, said clevis having aligned through-bores in its arms, and said release pin exerting a predetermined force to spread said spring arms apart;

an anchor line attachment lever having an upper terminal portion for attaching said anchor line, and a lower terminal portion having a through-bore and a camming end; and, a fulcrum pivot member securing said upper terminal portions of said spring arms, said arms of said clevis, and said lower terminal portion of said line lever so that said spreader bar is rotatably disposed on said fulcrum pivot member, said line lever is pivotably disposed on said fulcrum pivot member so as to engage said camming end with said upper terminal portion of said spreader bar.

2. The anchor of claim 1 wherein said spring yoke arms, said spreader bar and said flukes are formed from laminar metal stock.

3. The anchor of claim 1 wherein each said fluke is triangular in shape, each said inner edge is closely spaced relative to the outer surface of each said spring arm, and each said inner edge is provided with a clearance slot for said first detent means, said clearance slot allowing rotation of said fluke shaft and flukes into a vertical position.

4. The anchor of claim 1 wherein said line lever and said spreader bar are independently pivotable until said cam end is engaged in said clevis.

5. An anchor assembly comprising a sheath in which a self-trippable collapsible anchor is slidaly inserted, said anchor to be deployed with a single anchor line to anchor a relatively small water craft, said anchor comprising, a spring yoke having an "A"-shape, a fluke assembly journalled in the lower portion of said yoke, an actuator assembly comprising a spreader bar pivotably disposed about a fulcrum pivot member inserted through a clevis in its upper terminal portion, and a release pin projecting through said spreader bar's lower terminal portion, said clevis having aligned through-bores in its arms, and an anchor line attachment lever having an upper terminal portion for attaching said anchor line and a cam end pivotable about said fulcrum pivot, whereby said release pin is displaced by rotation of said spreader bar with a predetermined force exerted on said anchor line, the direction of such force being sufficient to cam said cam end in said clevis and angularly displace said spreader bar, essentially without regard for the force exerted on said flukes.

6. The anchor of claim 5 wherein said spring yoke comprises a pair of spring arms symmetrically disposed about a central vertical plane, said spring arms having upper and lower terminal portions having longitudinally aligned upper and lower through-bores, respectively, said lower terminal portions being longitudinally spaced apart at a distance greater than said upper terminal portions, each said lower portion having a longitudinally outwardly projecting first detent means.

7. The anchor of claim 6 wherein said fluke assembly comprises a pair of flukes fixedly disposed at opposite ends of a fluke shaft which is journalled in said lower throughbores of said spring arms, each said fluke having fixedly disposed near the inner edge thereof, a second detent means including a pair of diametrically opposite, longitudinally spaced apart, radially outwardly directed, detent tabs in selective interfering relationship with said first detent means.

8. The anchor of claim 7 wherein said fulcrum pivot member is a shoulder bolt having a relatively long smooth surfaced shank and a relatively short terminal threaded end.

9. The anchor of claim 5 wherein said sheath is formed with a cavity conforming generally to the shape of said anchor in a storage position, and said sheath is a rectangular parallelepiped.

* * * * *